US008342345B2

(12) United States Patent
Steele

(10) Patent No.: US 8,342,345 B2
(45) Date of Patent: Jan. 1, 2013

(54) ACCESSORY STORAGE CASE

(75) Inventor: Michael S. Steele, Waukesha, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 635 days.

(21) Appl. No.: 12/622,599

(22) Filed: Nov. 20, 2009

(65) Prior Publication Data

US 2010/0122983 A1 May 20, 2010

Related U.S. Application Data

(60) Provisional application No. 61/116,535, filed on Nov. 20, 2008.

(51) Int. Cl.

| | |
|---|---|
| ***B65D 6/28*** | (2006.01) |
| ***B65D 6/00*** | (2006.01) |
| ***B65D 8/14*** | (2006.01) |
| ***B65D 1/24*** | (2006.01) |

(52) U.S. Cl. ..... 220/4.03; 220/8; 220/531

(58) Field of Classification Search ..... 206/349, 206/351, 372, 373, 379, 745, 752, 756, 758; 220/4.01, 4.03, 8, 23.86, 23.87, 23.89, 531, 220/551, 720

See application file for complete search history.

(56) References Cited

U.S. PATENT DOCUMENTS

| | | | | |
|---|---|---|---|---|
| 695,660 | A | 3/1902 | Swan | |
| 876,235 | A | 1/1908 | Quackenboss | |
| 883,906 | A | 4/1908 | Swan | |
| 888,554 | A | 5/1908 | Tuttle | |
| 1,024,388 | A | 4/1912 | Bartlett | |
| 1,450,674 | A | 4/1923 | Marston | |
| 1,770,920 | A | 7/1930 | Hermani | |
| 1,859,772 | A | 5/1932 | Hiering | |
| 1,907,107 | A | 5/1933 | Hiering | |
| 1,934,138 | A | 11/1933 | Paul et al. | |
| 2,138,916 | A | 12/1938 | Gaess | |
| 2,256,257 | A | 9/1941 | Dukehart, Jr. | |
| D153,069 | S | 3/1949 | Linneman | |
| 2,501,270 | A * | 3/1950 | Fleming | 206/579 |

(Continued)

FOREIGN PATENT DOCUMENTS

| | | |
|---|---|---|
| DE | 21757 | 8/1961 |

(Continued)

*Primary Examiner* — Anthony Stashick
*Assistant Examiner* — Brett Edwards
(74) *Attorney, Agent, or Firm* — Michael Best & Friedrich LLP

(57) ABSTRACT

A storage case is provided for power tool accessories. The storage case comprises a first frame member having an inner surface and an edge defining a hinge portion, and a second frame member having an inner surface and an edge defining a hinge portion. A rod is positioned along a longitudinal axis of the storage case. The hinge portions of the first and second frame members are coupled to the rod to define a hinge positioned along a longitudinal axis of the storage case. The first and second frame members are pivotal with respect to each other between an open position and a closed position. An accessory receptacle, including a hinge boss, is received by the rod. When the first and second frame members are in the open position, the accessory receptacle is slidable along the rod between a plurality of axial positions. When the first and second frame members are in the closed position, the accessory receptacle is fixed in one of the axial positions within an interior cavity defined by the inner surfaces of the first and second frame members.

20 Claims, 10 Drawing Sheets

U.S. PATENT DOCUMENTS

| | | | | | |
|---|---|---|---|---|---|
| 2,584,721 | A | | 2/1952 | Linneman | |
| 2,589,234 | A | * | 3/1952 | Drohman | 206/379 |
| 2,670,842 | A | | 3/1954 | Kruft | |
| 2,827,004 | A | | 3/1958 | Luce et al. | |
| 3,072,244 | A | | 1/1963 | Smith | |
| 3,179,278 | A | | 4/1965 | Cohen | |
| 3,265,204 | A | | 8/1966 | Wozniak | |
| 3,294,225 | A | | 12/1966 | Kenyon | |
| 3,395,787 | A | | 8/1968 | Plaskan | |
| 3,454,151 | A | | 7/1969 | Plaskan | |
| 3,494,499 | A | | 2/1970 | Plog et al. | |
| 3,521,810 | A | | 7/1970 | Boyer | |
| 3,621,994 | A | | 11/1971 | Brown | |
| 3,817,372 | A | | 6/1974 | Smith | |
| 3,837,475 | A | | 9/1974 | Bolanz | |
| 3,904,035 | A | | 9/1975 | Metzler et al. | |
| 4,046,279 | A | | 9/1977 | Rosler | |
| 4,210,253 | A | | 7/1980 | Rosler | |
| 4,307,819 | A | | 12/1981 | Araki | |
| 4,402,423 | A | | 9/1983 | Skowronski et al. | |
| 4,445,611 | A | | 5/1984 | Shofu | |
| 4,509,656 | A | | 4/1985 | Rosler | |
| 4,596,340 | A | | 6/1986 | Luther | |
| 4,615,464 | A | | 10/1986 | Byrns | |
| 4,809,875 | A | | 3/1989 | Takano | |
| 4,840,288 | A | | 6/1989 | Lunderman et al. | |
| 4,884,317 | A | | 12/1989 | Liu | |
| 4,909,406 | A | | 3/1990 | Wu | |
| 4,938,355 | A | * | 7/1990 | Rocco | 206/372 |
| 5,076,428 | A | | 12/1991 | Shaw | |
| 5,139,186 | A | | 8/1992 | Loew et al. | |
| 5,248,030 | A | | 9/1993 | Tarozzi | |
| 5,288,453 | A | | 2/1994 | Rutenbeck et al. | |
| 5,509,527 | A | | 4/1996 | Wang | |
| 5,562,208 | A | | 10/1996 | Hasler et al. | |
| 5,562,212 | A | | 10/1996 | Rosler | |
| 5,638,957 | A | * | 6/1997 | Brasier | 206/581 |
| 5,642,832 | A | | 7/1997 | Favre | |
| 5,680,949 | A | | 10/1997 | Roesler | |
| 5,687,844 | A | | 11/1997 | Budert | |
| 5,829,591 | A | | 11/1998 | Lyons | |
| 5,829,596 | A | | 11/1998 | Budert | |
| 5,893,457 | A | | 4/1999 | Wei | |
| 5,960,744 | A | | 10/1999 | Rutman | |
| 5,967,318 | A | | 10/1999 | Rosler | |
| 5,992,665 | A | | 11/1999 | Deeter | |
| 6,116,447 | A | | 9/2000 | Daoud | |
| 6,283,291 | B1 | | 9/2001 | Vasudeva et al. | |
| 6,298,857 | B1 | | 10/2001 | Schmidt | |
| 6,315,408 | B1 | * | 11/2001 | Huang | 351/128 |
| 6,648,166 | B2 | | 11/2003 | Levy | |
| 6,753,537 | B2 | | 6/2004 | Woo | |
| 6,866,147 | B2 | | 3/2005 | Barwick | |
| 7,014,058 | B2 | | 3/2006 | Gledhill | |
| 7,228,983 | B2 | * | 6/2007 | Pangerc et al. | 220/23.87 |
| 7,237,688 | B2 | | 7/2007 | Pangerc et al. | |
| 7,249,676 | B2 | | 7/2007 | Wang | |
| D550,959 | S | | 9/2007 | Miller et al. | |
| 7,264,118 | B2 | | 9/2007 | Chen | |
| 7,306,099 | B2 | | 12/2007 | Chen | |
| 7,325,682 | B2 | | 2/2008 | Seymour et al. | |
| 7,341,144 | B2 | | 3/2008 | Tajiri et al. | |
| 7,367,451 | B2 | | 5/2008 | Pendergraph et al. | |
| 7,367,467 | B2 | * | 5/2008 | Bashuk | 220/4.03 |
| 7,401,700 | B2 | | 7/2008 | Dost et al. | |
| 7,484,620 | B2 | | 2/2009 | Miller et al. | |
| 2001/0008215 | A1 | | 7/2001 | Colombo | |
| 2004/0195113 | A1 | | 10/2004 | Yoshizawa | |
| 2004/0232016 | A1 | | 11/2004 | Dietrich | |
| 2005/0178695 | A1 | | 8/2005 | Petit | |
| 2006/0283870 | A1 | | 12/2006 | Au | |
| 2007/0114150 | A1 | * | 5/2007 | Lin | 206/372 |

FOREIGN PATENT DOCUMENTS

| | | |
|---|---|---|
| DE | 1927578 | 11/1965 |
| DE | 2431672 | 1/1976 |
| DE | 7620793 | 10/1976 |
| DE | 3211146 | 10/1983 |
| DE | 3325033 | 3/1984 |
| DE | 29904031 | 7/1999 |
| EP | 1116558 | 7/2001 |
| FR | 2204488 | 5/1974 |
| FR | 2797798 | 3/2001 |
| WO | 94/24008 | 10/1994 |

* cited by examiner

ACCESSORY STORAGE CASE

CROSS-REFERENCE TO RELATED APPLICATION

This application claims priority to U.S. Provisional Patent Application No. 61/116,535 filed on Nov. 20, 2008, the entire contents of which are hereby incorporated by reference.

BACKGROUND

The present invention relates to power tools, and more particularly to a storage case for accessories for power tools.

Interchangeable accessories are generally used with power tools. The accessories can be of various dimensions and utility. Such accessories are typically stored in a tool box or other storage case separate from the power tool. Storing the accessories together in a storage case minimizes the risk of misplacing the accessories or damaging the accessories. Since the accessories may be of various length, it is desirable to provide a storage case that is adjustable for different size accessories.

SUMMARY

In one embodiment, the invention provides a storage case for power tool accessories. The storage case comprises a first frame member having an inner surface and an edge defining a hinge portion, and a second frame member having an inner surface and an edge defining a hinge portion. A rod is positioned along a longitudinal axis of the storage case. The hinge portions of the first and second frame members are coupled to the rod to define a hinge positioned along a longitudinal axis of the storage case. The first and second frame members are pivotal with respect to each other between an open position and a closed position. An accessory receptacle, including a hinge boss, is received by the rod. When the first and second frame members are in the open position, the accessory receptacle is slidable along the rod between a plurality of axial positions. When the first and second frame members are in the closed position, the accessory receptacle is fixed in one of the axial positions within an interior cavity defined by the inner surfaces of the first and second frame members.

In another embodiment, the invention provides a storage case for power tool accessories. The storage case comprises a first frame member including a first side wall, a second side wall, and a base wall, the first frame member including an interior area defined between the walls and a second frame member including a first side wall, a second side wall, and a base wall, the second frame member including an interior area defined between the walls. The second side wall of the first frame member is coupled to the first side wall of the second frame member and the first and second frame members are pivotal with respect to each other between an open position and a closed position, and in the closed position the interior areas of the first and second frame members define an interior cavity. A pivot member is positioned along the first side wall of the first frame member and the second side wall of the second frame member. The pivot member defines a pivot axis of the storage case. An accessory receptacle is positioned within the interior area of one of the first and second frame members and movably coupled to the pivot member. The accessory receptacle is movable between a first axial position and a second axial position when the first and second frame members are in the open position. When the frame members are in the closed position, the accessory receptacle is fixed in one of the axial positions within the interior cavity.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting.

DETAILED DESCRIPTION

FIGS. 1A-4B illustrate a storage case 10 according to one embodiment of the invention, which is capable of storing various sizes and number of power tool accessories (not shown). The storage case 10 includes a first frame member 14*a* and a second frame member 14*b*. Each of the frames members 14*a*, 14*b* includes a base wall 18*a*, 18*b*, a first side wall 22*a*, 22*b*, a second side wall 26*a*, 26*b*, a first end wall 30*a*, 30*b*, and a second end wall 34*a*, 34*b*, respectively. The walls of each frame 14*a*, 14*b* define an interior area 38*a*, 38*b*.

Figure 1A:
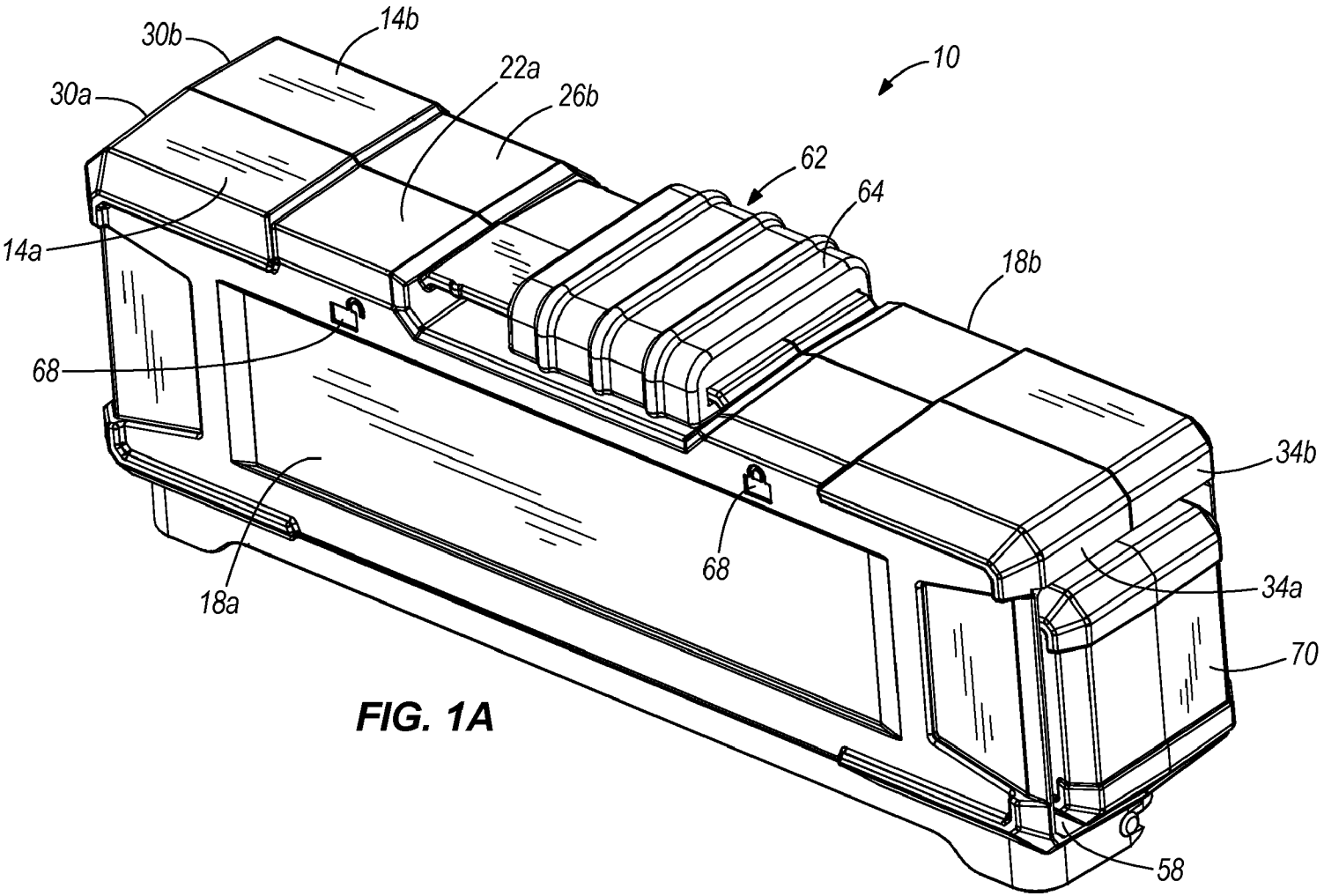
FIG. 1A is a perspective view of a storage case according to one embodiment of the invention.
Figure 1B:
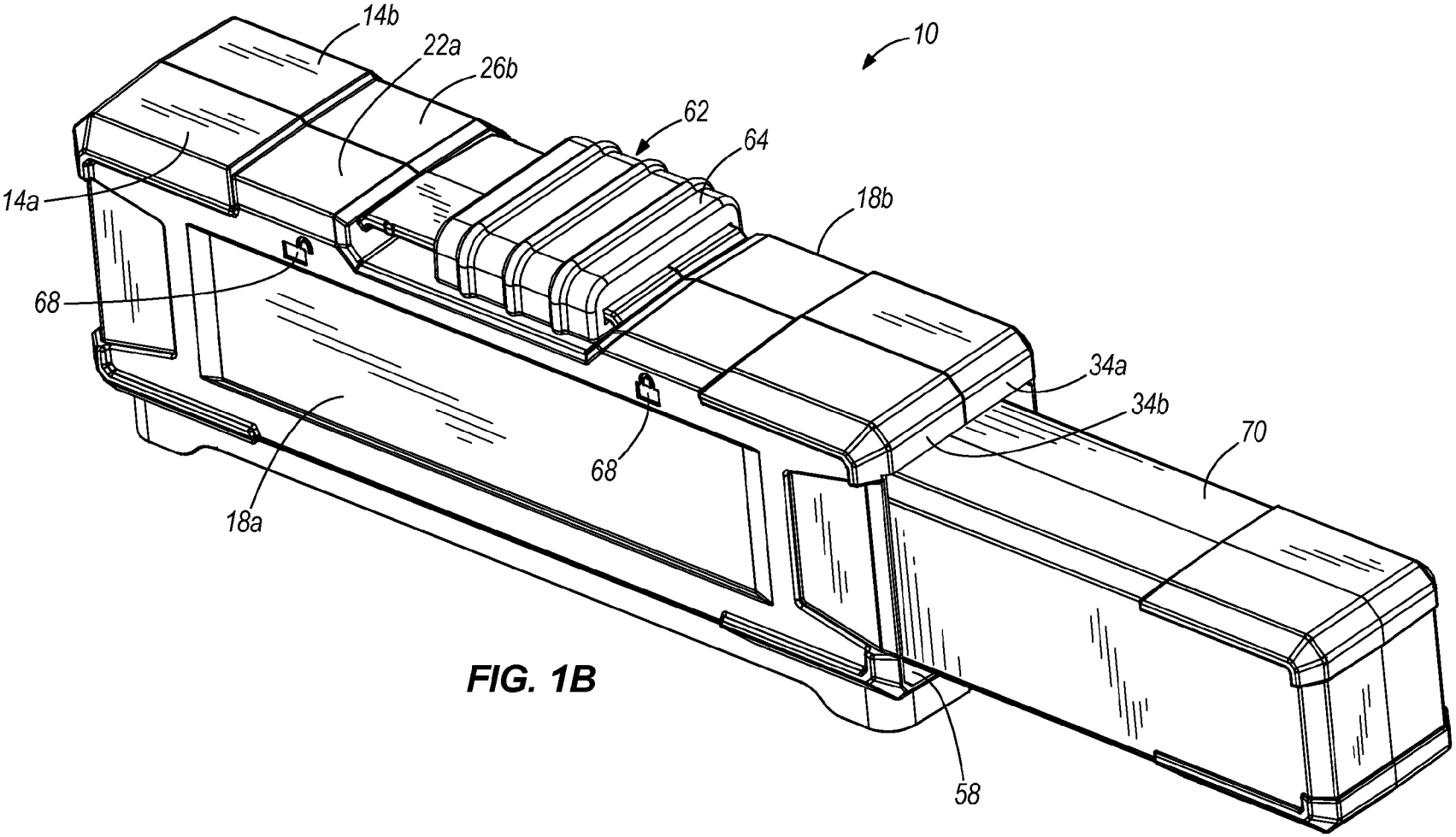
FIG. 1B is a perspective of the storage case of FIG. 1A with an accessory receptacle in an extended position.
Figure 2A:
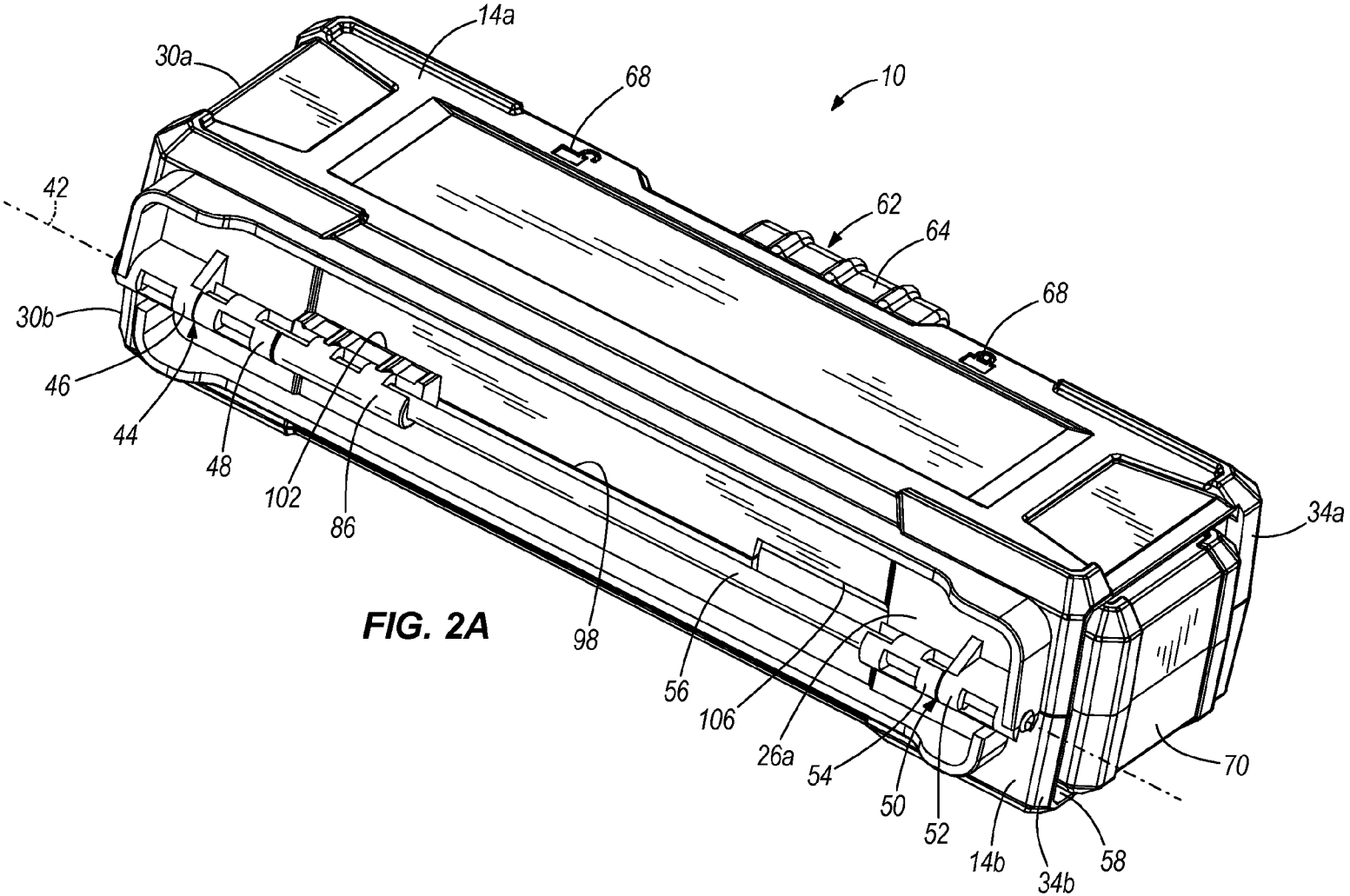
FIG. 2A is a perspective view of another side of the storage case of FIG. 1A.
Figure 2B:
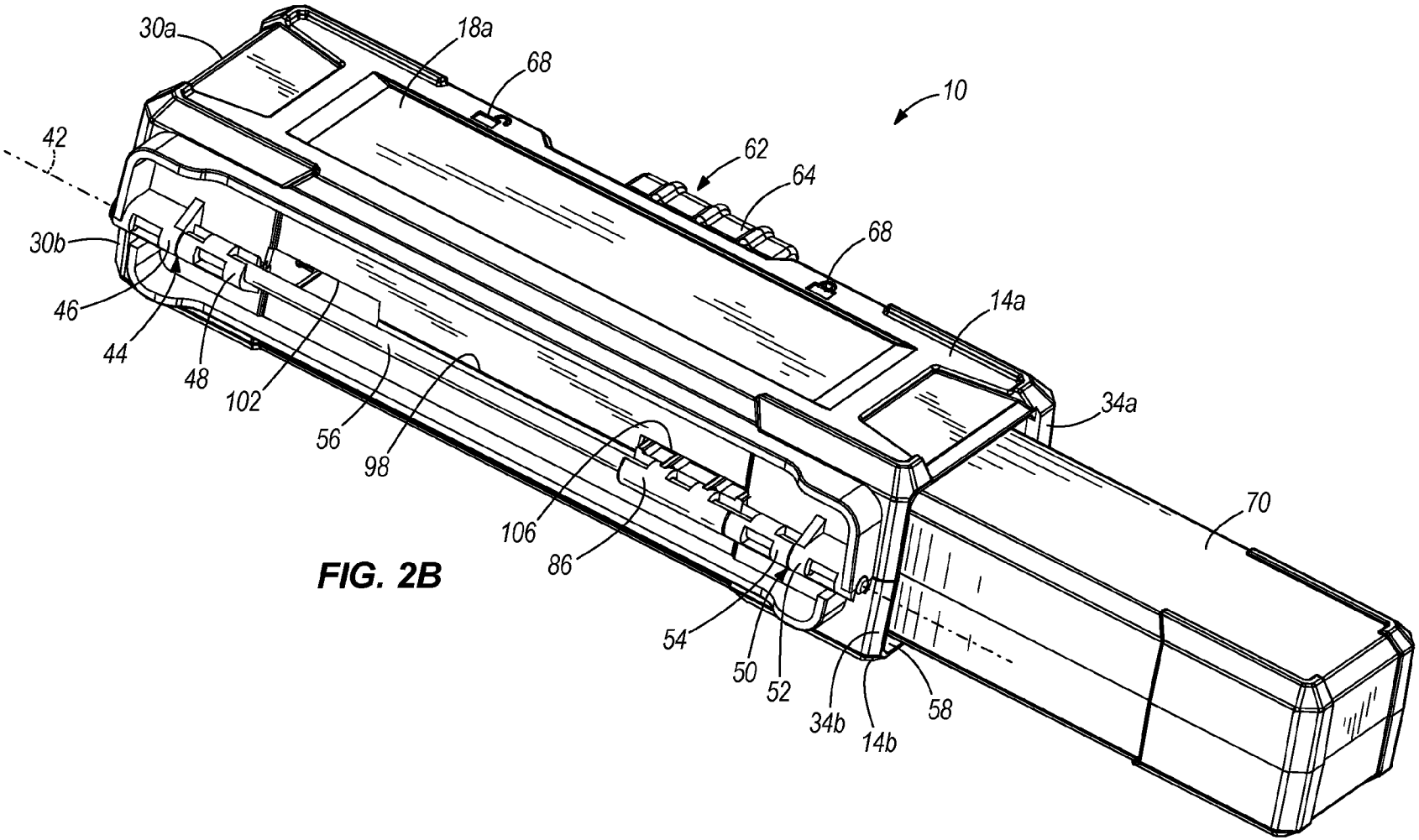
FIG. 2B is a perspective view of the storage case of FIG. 2A with the accessory receptacle in an extended position.

Referring to FIGS. 2A and 2B, the first frame member 14*a* and second frame member 14*b* are pivotally coupled together about a pivot axis 42 of the storage case 10 by a pair of hinge assemblies. The pivot axis 42 also defines a longitudinal axis of the storage case when the storage case is in an open position (FIGS. 3A-4B). In the illustrated embodiment, a first hinge assembly 44 includes a hinge member 46 formed on the second side wall 26*a* of the first frame member 14*a* and a hinge member 48 formed on the first side wall 22*b* of the second frame 14*b*. A second hinge assembly 50 includes a hinge member 52 formed on the second side wall 26*a* of the first frame 14*a* and a hinge member 54 formed on the first side wall 22*b* of the second frame 14*b*. A rod 56 is received by the hinge members 46, 48, 52, 52, and thereby the hinges 44, 50 such that the rod 56 forms a common pivot pin along the axis 42 about which the frames members 14*a*, 14*b* pivot relative to each other. In another embodiment, a portion of the side walls 26*a*, 22*b* extend substantially around a portion of the hinge assemblies 44, 50 and the rod 56 to provide protection to the hinges 44, 50 and rod 56 from external impacts.

The hinge assemblies 44, 50 of the first frame member 14*a* and second frame member 14*b* facilitate moving the storage case 10 from a closed position (illustrated in FIGS. 1A, 1B, 2A and 2B) to an open position (illustrated in FIGS. 3A, 3B, 4A and 4B). In the closed position, edge surfaces of the walls 22*a*, 26*a*, 30*a*, 34*a* of the first frame 14*a* and the walls 22*b*, 26*b*, 30*b*, 34*b* of the second frame 14*b* mate together such that the interior area 38*a* of the first frame 14*a* and the interior area 38*b* of the second frame 14*b* face each other. The interior areas 38*a*, 38*b* of the frames 14*a*, 14*b* are configured to form an interior cavity 58 when the storage case 10 is in the closed position. In the open position, the first side wall 22*a* of the first frame 14*a* and the second side wall 26*b* of the second frame 14*b* are drawn apart from one another (i.e., pivoted away from one another).

As illustrated in FIGS. 1A, 1B, 3A and 3B, the storage case 10 further includes a closure mechanism 62 for selectively locking the first frame member 14*a* and second frame member 14*b* in the closed position. The closure mechanism 62 includes a lock member 64 slidably coupled to the first side wall 22*a* of the first frame 14*a* and a hook portion 66 (FIGS. 3A and 3B) integrally formed on the second side wall 26*b* of the second frame 14*b*. The lock member 64 is slid towards the second end wall 34*a*, 34*b* to lock the storage case 10 in the closed position, as illustrated in FIGS. 1A, 1B, 2A, and 2B. The lock member 64 slides over the hook portion 66 to receive the hook portion 66, thereby preventing the first and second frame members 14*a*, 14*b* from being pivoted from the closed position to the open position. Sliding the lock member 64 towards the first end wall 30*a*, 30*b* unlocks the case, allowing the first and second frame members 14*a*, 14*b* to be pivoted to the open position. In the illustrated embodiment, position indicator markings 68 give a user visual indication of the lock position. In another embodiment, the lock member 64 is positioned on the second frame 14*b* and the hook portion 66 is positioned on the first frame 14*a*. In still further embodiments, other types of locking or closure mechanisms may be used, including but not limited to, a snap closure, rotating clasps, sliding bolts, Velcro™, or the like. The closure mechanism is selectively engageable and sufficiently strong to prevent the case from opening inadvertently.

Figure 5:
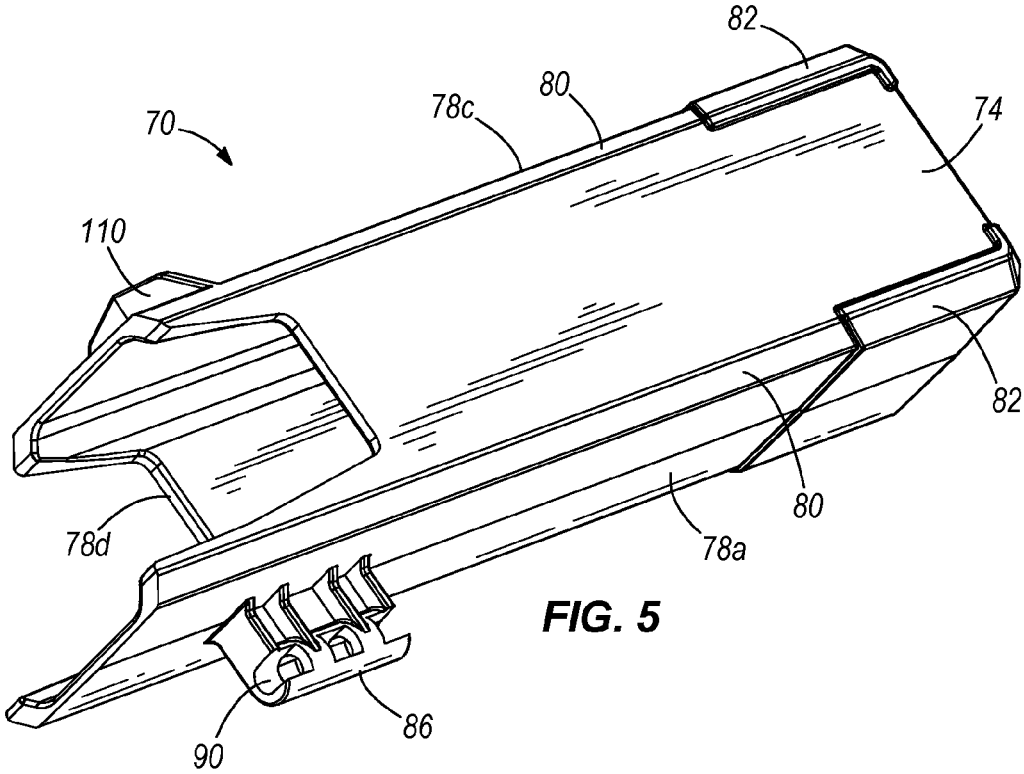
FIG. 5 is a perspective view of the accessory receptacle of the storage case of FIGS. 1A-4B.

The storage case 10 includes an accessory receptacle 70, which is retained within the cavity 58 defined by the interior areas 38*a*, 38*b* of frame members 14*a*, 14*b*. The accessory receptacle 70, illustrated in FIG. 5, is sized and shaped to receive and retain a plurality of power tool accessories (not shown), including, but not limited to, saw blades, drill bits, and other power tool accessories. The accessory receptacle 70 includes a base wall 74 and side walls 78*a*, 78*b*, 78*c*, 78*d*. The side walls 78*a*, 78*b*, 78*c*, 78*d* of the accessory receptacle 70 include edge bevels 80 and corner reinforcements 82; however, in other embodiments, the side walls of the accessory receptacle 70 may be smooth.

The accessory receptacle 70 includes a hinge boss 86 extending outwardly from the side wall 78*a*. The hinge boss 86 includes an aperture 90 for slidably receiving the rod 56 of the storage case 10. The accessory receptacle 70 may slide along the rod 56 between the first hinges 46 and the second hinges 50 of the frames members 14*a*, 14*b* when the storage case 10 is in the open position. Referring to FIGS. 2A, 2B, 4A, 4B and 5, the hinge boss 86 includes various surface contours and apertures in addition to the aperture 90; however, in an embodiment of an accessory receptacle 1070 shown in FIG. 7, a hinge boss 1086 has a smooth, cylindrical profile.

FIGS. 2A-6 illustrate axial position-retaining features of the frames members 14*a*, 14*b* and the accessory receptacle 70. The storage case 10 utilize a combination of position-retaining features that allow for the accessory receptacle 70 to be selectively placed in a first axial position or a second axial position with respect to the axis 42 when the frame members 14*a*, 14*b* are in the open position. When the frame members 14*a*, 14*b* are in the closed position, the position-retaining features capture the accessory receptacle in either the first or second axial position. Each of the end walls 34*a*, 34*b* of the frames 14*a*, 14*b* includes an opening 94*a*, 94*b*, respectively, formed therein to permit the accessory receptacle 70 to extend beyond the interior cavity 58 of the storage case 10. As illustrated in FIGS. 1A, 2A, 3A and 4A, when the accessory receptacle 70 is in the first axial position, the receptacle 70 is substantially contained within the interior cavity 58. As illustrated in FIGS. 1B, 2B, 3B and 4B, when the accessory receptacle 70 is in the second axial position, a substantial portion of the accessory receptacle 70 extends outwardly from the interior cavity 58 and is external to the first and second frame members 14*a*, 14*b*.

The second side wall 26*a* of the first frame member 14*a* and the first side wall 22*b* of the second frame member 14*b* each include slots 102, 106 formed along an edge surface. A lip 98 is defined by each of the side walls 26*a*, 22*b* between the slots 102, 106. In another embodiment, either or both of the slots 102, 106 may only be formed in one of the frames members 14*a* 14*b*. The first slot 102 is positioned proximate the hinge member 46, 52 of the respective side wall 26*a*, 22*b*, and the second slot 106 is positioned proximate the hinge member 48, 54 of the respective side wall 26*a*, 22*b*. The first slot 102 and the second slot 106 are sized and shaped to receive the hinge boss 86 of the accessory receptacle 70.

In the illustrated embodiment, the accessory receptacle 70 includes a tab member 110 that projects outwardly from the side wall 78*c*. Each of the frame members 14*a*, 14*b* includes a pair of slots 112, 114 defined along the first side wall 22*a* and the second side wall 26*b*, respectively. Each slot 112, 114 is formed by a pair of projections 116 that extend inwardly from the side wall into the interior area of the respective frame. As illustrated in FIGS. 3A-4B and 6, the tab member 110 of the accessory receptacle 70 is seated in one pair of the slots 112, 114 to maintain the accessory receptacle 70 in one of the axial positions. When the tab member 110 is retained within the slot 112, the accessory receptacle 70 is held in the first axial position. When the tab member 110 is retained within the slot 114, the accessory receptacle 70 is held in the second axial position. The projections 116 defining the slots 112, 114 capture the tab member 110 when the first and second frame members 14*a*, 14*b* are in the closed position to prevent movement of the accessory receptacle 70 in an axial direction within the interior cavity 58.

Figure 3A:
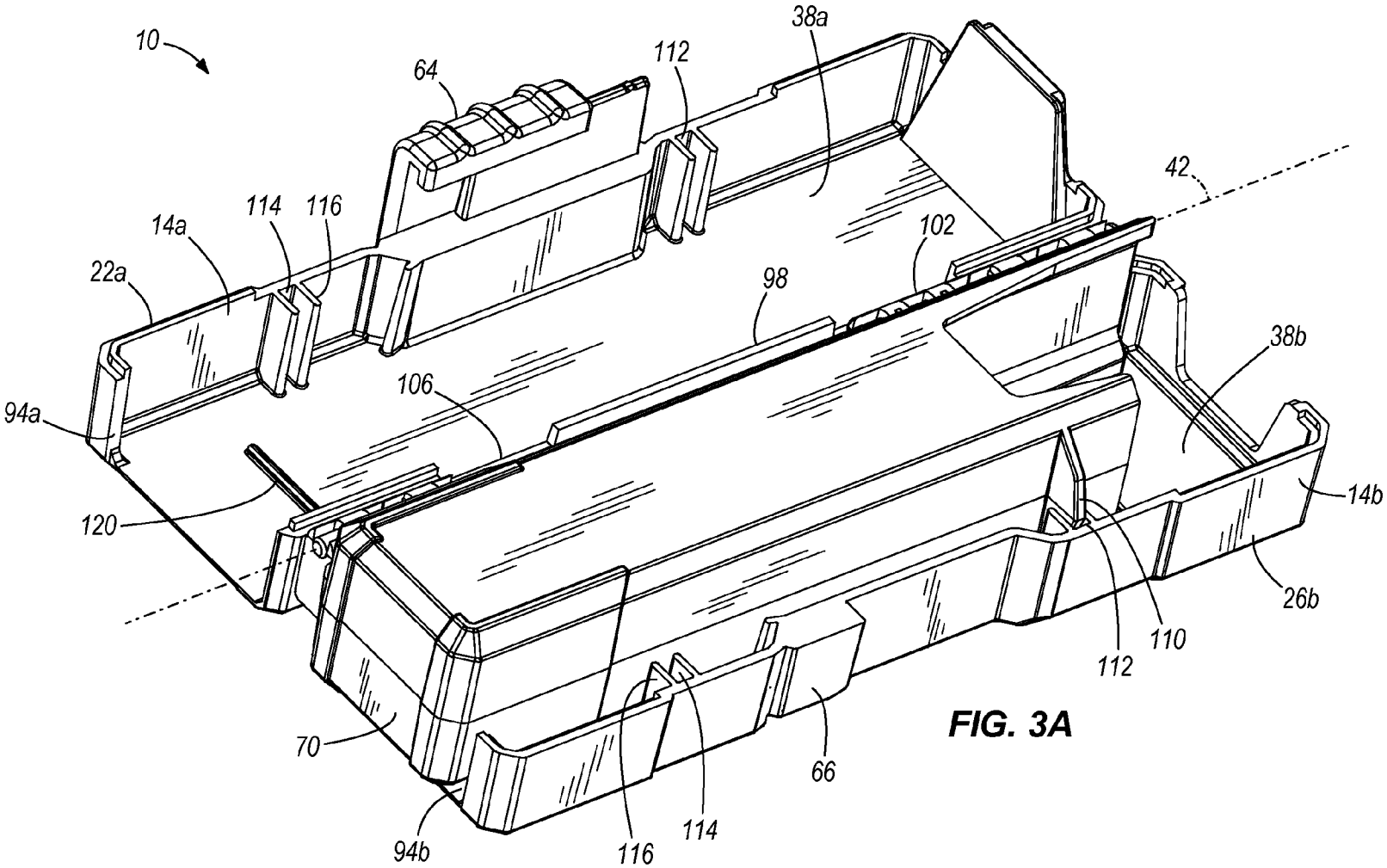
FIG. 3A is a perspective view of the storage case of FIG. 1A in an open position.
Figure 3B:
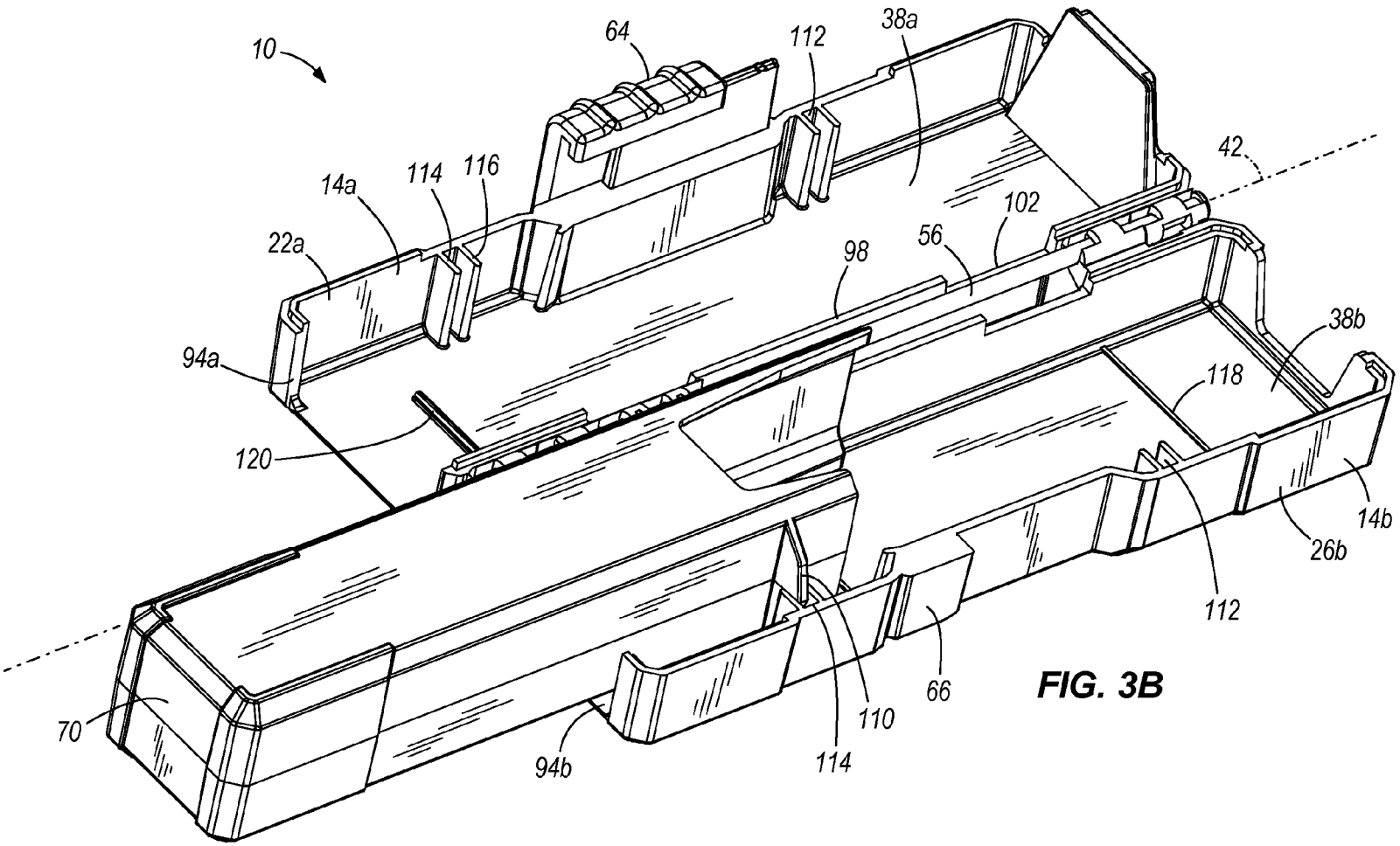
FIG. 3B is a perspective view of the storage case of FIG. 3A with the accessory receptacle in an extended position.
Figure 4A:
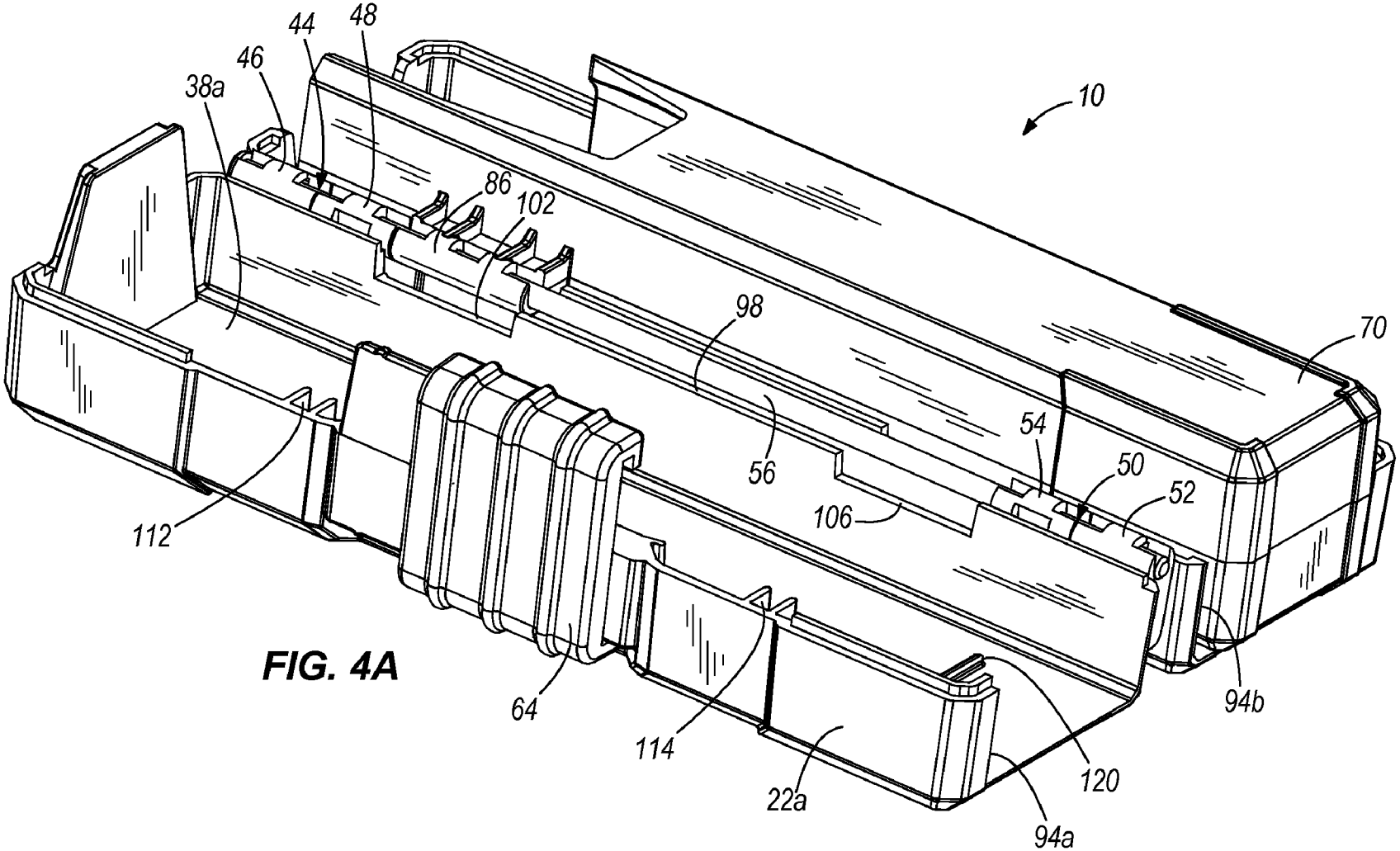
FIG. 4A is another perspective view of the storage case of FIG. 1A in an open position.
Figure 4B:
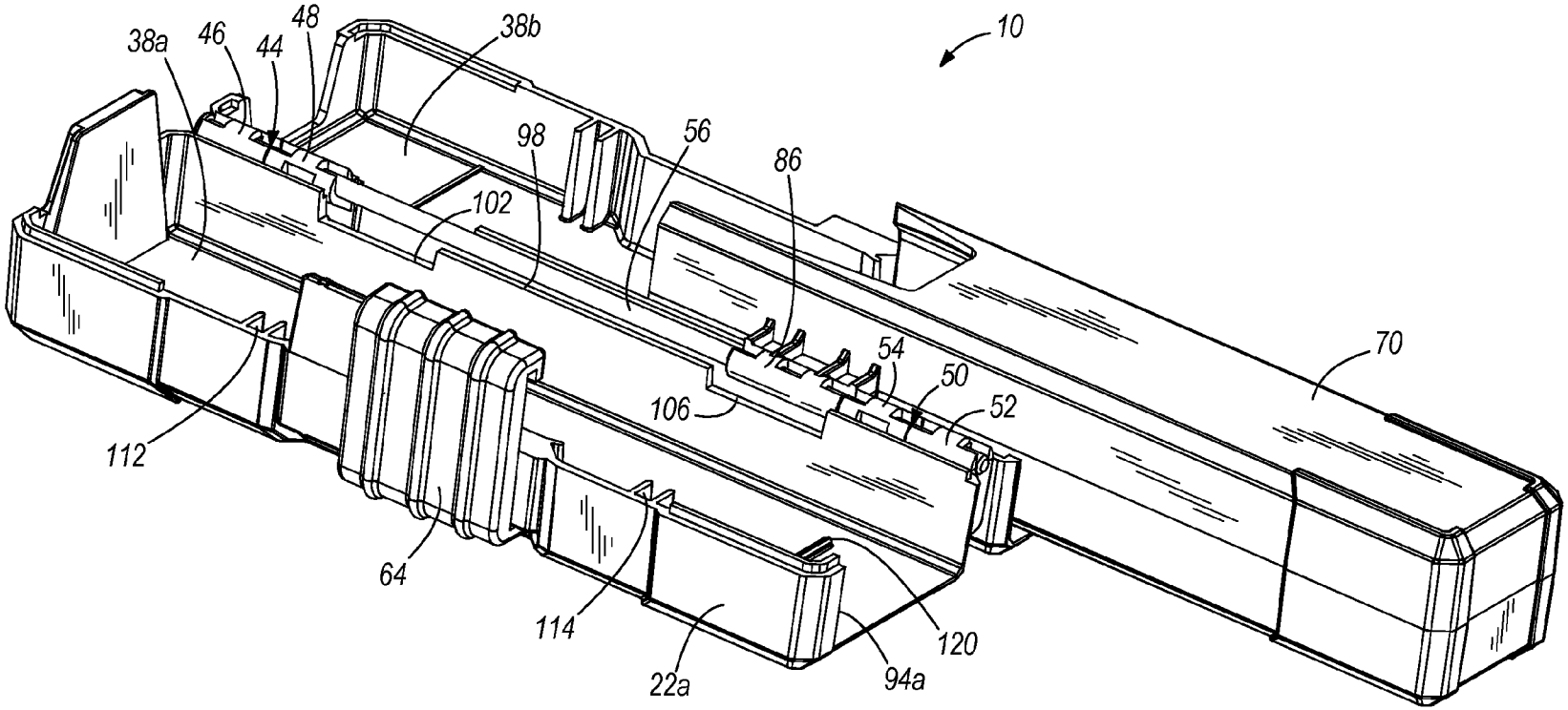
FIG. 4B is a perspective view of the storage case of FIG. 4A with the accessory receptacle in an extended position.
Figure 6:
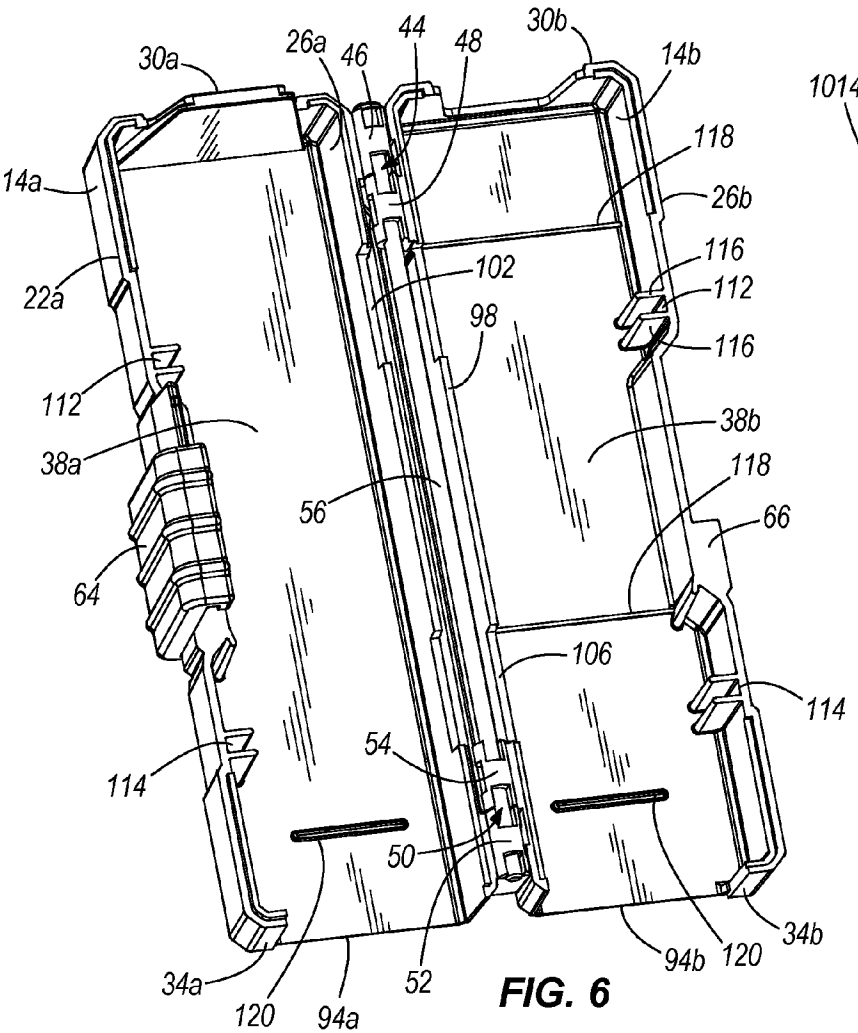
FIG. 6 is a perspective view of a first frame and a second frame of the storage case in an open position.

In order to transition the accessory receptacle between a first axial position (non-extended) and second axial position (extended), the accessory storage case 10 must be in the open position. A user rotates the accessory receptacle about rod 56 such that the hinge boss 86 rotates out of the slot 102 or 106 and the tab member 110 rotates out of the slot 112 or 114. The accessory receptacle 70 is then slidingly repositioned along rod 56 to either the first or second axial position. The accessory receptacle 70 is rotated such that hinge boss 86 is captured within the corresponding slot 102 or 106 and the tab member 110 positioned within the corresponding slot 112 or 114. As illustrated in FIGS. 3B, 4B and 6, internal position indicating lines 118 aid the user is aligning the accessory receptacle at either the first or second axial position.

As shown in FIGS. 2A and 2B, when the storage case 10 is in the closed position, the hinge boss 86 is locked into either the first slot 102 or the second slot 106 depending upon the selected axial position of the accessory receptacle 70. The slots 102, 106 prevent movement of the accessory receptacle 70 when the storage case 10 is in the closed position by preventing movement of the hinge boss 86 along the rod 58. Furthermore, in the embodiment illustrated in FIGS. 1A-6, the tab member 110 of the accessory receptacle 70 is captured within either of the slots 112, 114 defined on the first and second frame members 14*a*, 14*b*. Although shown as having two hinge slots 102, 106 and two sets of side wall slots 112, 114, the storage case 10 may include more than two hinge slots or more than two sets of side wall slots to provide for additional positions of the accessory receptacle 70 between the fully extended position and the non-extended position.

The tab members 110 and the projections 116 illustrated in FIGS. 3A-6 serve an additional axial position-retaining function to the hinge boss 86 and the slots 102, 106. In addition, the illustrated embodiment of the storage case 10 includes lateral guide members 120 formed on the base walls 18*a*, 18*b* of the frame members 14*a*, 14*b*. The lateral guide members 120 center the accessory 70 receptacle within the interior cavity 58 when the frame members 14*a*, 14*b* are in the closed position. In another embodiment, the lateral guide members 120 may be formed on other surfaces within the interior areas 38*a*, 38*b* of the frame members 14*a*, 14*b*. The use of two position-retaining features in the storage case 10 provides maximum axial and lateral support to the accessory receptacle 70 so as to prevent tilting or binding within the interior cavity 58.

Figure 7:
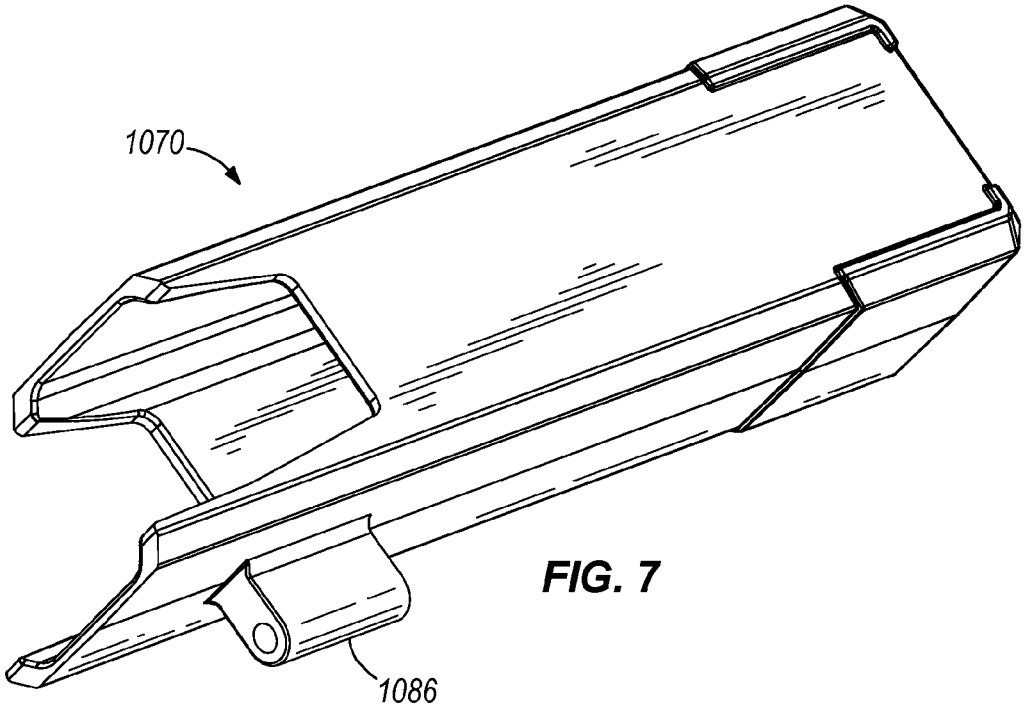
FIG. 7 is a perspective view of an accessory receptacle according to another embodiment invention.
Figure 8:
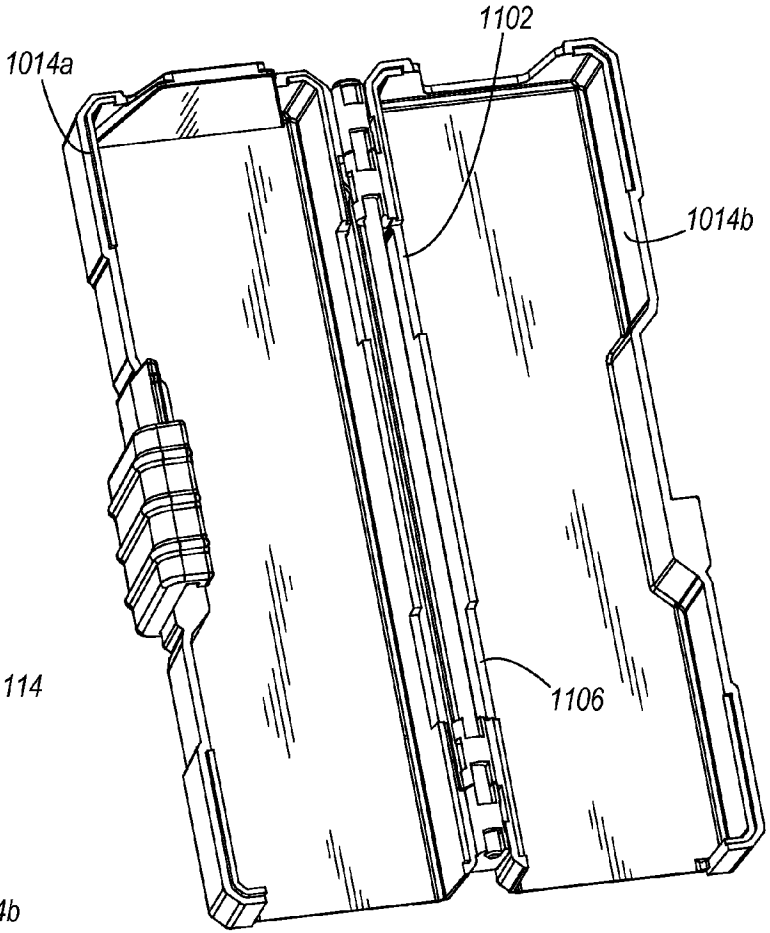
FIG. 8 is a perspective view of first and second frames of a storage case according to another embodiment of the invention.

FIG. 7 illustrates the accessory receptacle 1070 and FIG. 8 illustrates frame members 1014*a*, 1014*b* according to another embodiment of the invention. In this embodiment, the tab member and corresponding projections are not present. The axial position-retaining function is accomplished by a hinge boss 1086 mating with either a first slot 1102 or a second slot 1106 formed in the frame members 1014*a*, 1014*b*. In still other embodiments, the axial position retaining function may be accomplished by a tab member and corresponding set of projections, without a hinge boss mating with corresponding slots.

In the illustrated embodiment, the storage case 10 is sized and shaped to have a capacity for accessories having a length of six inches when the accessory receptacle 70 is in the non-extended position and a length of nine inches when the accessory receptacle 70 is in the extended position. In other embodiments, the storage case 10 may have a capacity of less than six inches or greater than six inches when the accessory receptacle 70 is in the non-extended position and a capacity of less than nine inches or greater than nine inches when the accessory receptacle 70 is in the extended position. Furthermore, as shown, the storage case 10 is sized and shaped to store approximately twenty-five accessory blades; however, in other embodiments, the storage case 10 may retain more than twenty-five accessory blades or less than twenty-five accessory blades, as well as other types of accessories.

The storage case 10, including the first frame 14*a*, second frame 14*b* and accessory receptacle 70, is designed to have impact absorbing characteristics to protect the accessories within the case 10 from impacts at a jobsite, such as from falling from a height or having another object impact the case. For example, the first frame 14*a*, second frame 14*b*, and the accessory receptacle 70 may be formed of energy/impact absorbing materials, such as, for example, high-density polyethylene (HDPE), and/or formed with energy/impact absorbing structures, such as for example, bumpers and energy-absorbing shapes, etc. Further, the first frame 14*a*, the second frame 14*b*, and the accessory receptacle 70 may be formed from other materials or a variety of materials, including but not limited to, plastics, metals, or other material. The first frame 14*a*, the second frame 14*b*, and the accessory receptacle may also be manufactured by a variety of processes, including but not limited to, blow-molding, injection molding, or other manufacturing process.

In some embodiments, portions of the accessory storage case frame members may be molded or otherwise formed from a translucent or transparent material to create a window with which to view the internal contents of the storage case. The window or a plurality of windows may be positioned at any location on the storage case that does not interfere with the movement of the accessory receptacle between the extended and non-extended positions or interfere with the pivoting of the first and second frames.

Although particular constructions embodying independent aspects of the present invention have been shown and described, other alternative constructions will become apparent to those skilled in the art and are within the intended scope of the independent aspects of the present invention. Various features and advantages of the invention are set forth in the following claims.

What is claimed is:

1. A storage case for power tool accessories, the storage case comprising:

a first frame member having an inner surface and an edge defining a hinge portion;

a second frame member having an inner surface and an edge defining a hinge portion;

a rod positioned between the first and second frame members, wherein the hinge portions of the first and second frame members are coupled to the rod to define a hinge positioned along a longitudinal axis of the storage case, and further wherein the first and second frame members are pivotable with respect to each other between an open position and a closed position; and an accessory receptacle positioned within one of the first and second frame members, the accessory receptacle including a hinge boss received by the rod, wherein when first and second frame members are in the open position, the accessory receptacle is slidable along the rod between a plurality of axial positions, and when the first and second frame members are in the closed position, the accessory receptacle is fixed in one of the axial positions within an interior cavity defined by the inner surfaces of the first and second frame members.

2. The storage case of claim 1, further comprising a first slot formed in the edge of one of the first and second frame members and a second slot formed in the edge of one of the first and second frame members, wherein the hinge boss is seated in the first slot when the accessory receptacle is in a first of the plurality of axial positions and the hinge boss is seated in the second slot when the accessory receptacle is in a second of the plurality of axial positions.

3. The storage case of claim 1, wherein each of the first frame member, the second frame member, and the accessory receptacle pivot about the rod.

4. The storage case of claim 1, wherein the accessory receptacle includes an outer surface with a tab member extending outwardly from the outer surface, wherein one of the first and second frame members includes a projection extending from the inner surface of the frame member, and further wherein the tab is engaged by the projection when the first and second frame members are in the closed position and the accessory receptacle is in one of the plurality of axial positions.

5. The storage case of claim 4, wherein the projection captures the tab member to prevent movement in an axial direction.

6. The storage case of claim 1, further comprising a latch mechanism operable to selectively secure the first and second frame members in the closed position.

7. The storage case of claim 6, wherein the latch mechanism includes a closure mechanism movably coupled to the first frame member and a hook portion formed on the second frame member, and further wherein the closure mechanism receives the hook portion to secure the frame members in the closed position.

8. The storage case of claim 1, wherein the first frame member, second frame member, and accessory receptacle are formed of an impact absorbing material.

9. The storage case of claim 8, wherein the impact absorbing material is high density polyethelene.

10. A storage case for power tool accessories, the storage case comprising:

a first frame member including a first side wall, a second side wall, and a base wall, the first frame member including an interior area defined between the walls;

a second frame member including a first side wall, a second side wall, and a base wall, the second frame member including an interior area defined between the walls, wherein the second side wall of the first frame member is coupled to the first side wall of the second frame member and the first and second frame members are pivotal with respect to each other between an open position and a closed position, and further wherein in the closed position the interior areas of the first and second frame members define an interior cavity;

a pivot member positioned along the first side wall of the first frame member and the second side wall of the second frame member, the pivot member defining a pivot axis of the storage case;

an accessory receptacle positioned within the interior area of one of the first and second frame members and movably coupled to the pivot member, the accessory receptacle movable between a first axial position and a second axial position when the first and second frame members are in the open position, wherein when the frame members are in the closed position, the accessory receptacle is fixed in one of the axial positions within the interior cavity.

11. The storage case of claim 10, wherein the accessory receptacle further comprises a hinge boss including an aperture for receiving the pivot member.

12. The storage case of claim 11, further comprising a first slot formed in one of the second side wall of the first frame member and the first side wall of the second frame member and a second slot formed in one of the second side wall of the first frame member and the first side wall of the second frame member, wherein the hinge boss is seated in the first slot when the accessory receptacle is in the first axial position and the hinge boss is seated in the second slot when the accessory receptacle is in the second axial position.

13. The storage case of claim 10, wherein when the accessory receptacle is in the first axial position, a substantial portion of the accessory receptacle is positioned within the interior cavity.

14. The storage case of claim 10, wherein when the accessory receptacle is in the second axial position, at least a portion of the accessory receptacle extends outwardly from the interior cavity and is external to the frame members.

15. The storage case of claim 10, wherein the pivot member is a rod.

16. The storage case of claim 15, wherein the first frame member, the second frame member and the accessory receptacle are each coupled to the rod.

17. The storage case of claim 10, wherein the accessory receptacle includes an outer surface with a tab member extending outwardly from the outer surface, wherein one of the first and second frame members includes a projection extending from the interior area of the frame member, and further wherein the tab is engaged by the projection when the first and second frame members are in the closed position and the accessory receptacle is in one of the first and second axial positions.

18. The storage case of claim 17, wherein the projection captures the tab member to prevent movement in an axial direction.

19. The storage case of claim 10, further comprising a latch mechanism operable to selectively secure the first and second frame members in the closed position.

20. The storage case of claim 19, wherein the latch mechanism includes a lock member movably coupled to the first frame member and a hook portion formed on the second frame member, and further wherein the lock member receives the hook portion to secure the frame members in the closed position.

* * * * *